US011484136B2

(12) United States Patent
Chuang

(10) Patent No.: US 11,484,136 B2
(45) Date of Patent: Nov. 1, 2022

(54) PORTABLE REUSABLE UTENSIL

(71) Applicant: YUAN MIN ALUMINUM CO., LTD., Tainan (TW)

(72) Inventor: Ming-Han Chuang, Tainan (TW)

(73) Assignee: Yuan Min Metal Technology Co., Ltd., Tainan (TW)

( * ) Notice: Subject to any disclaimer, the term of this patent is extended or adjusted under 35 U.S.C. 154(b) by 71 days.

(21) Appl. No.: 17/086,879

(22) Filed: Nov. 2, 2020

(65) Prior Publication Data

US 2022/0022674 A1 Jan. 27, 2022

(30) Foreign Application Priority Data

Jul. 23, 2020 (TW) ..... 109209463

(51) Int. Cl.

| | |
|---|---|
| ***A47G 21/02*** | (2006.01) |
| ***A47G 21/04*** | (2006.01) |
| ***B26B 5/00*** | (2006.01) |
| ***B25G 1/08*** | (2006.01) |
| *A47G 21/00* | (2006.01) |

(52) U.S. Cl.

CPC ..... *A47G 21/02* (2013.01); *A47G 21/023* (2013.01); *A47G 21/04* (2013.01); *B25G 1/08* (2013.01); *B26B 5/00* (2013.01); *A47G 2021/002* (2013.01)

(58) Field of Classification Search

CPC ..... A47G 21/02; A47G 21/023; A47G 21/04; A47G 21/06; A47G 21/08; A47G 2021/002; B26B 5/00

USPC ..... 30/142, 143, 147–150, 322–328

See application file for complete search history.

(56) References Cited

U.S. PATENT DOCUMENTS

| | | | | | |
|---|---|---|---|---|---|
| 812,424 | A * | 2/1906 | Hellmuth | B67B 7/38 | 30/147 |
| 1,053,387 | A * | 2/1913 | Hawley | A47G 21/06 | 30/147 |
| 1,452,337 | A * | 4/1923 | Brecel | A47G 21/06 | 30/143 |
| 2,109,016 | A * | 2/1938 | Ringer | A47G 21/06 | D7/645 |
| 2,439,882 | A * | 4/1948 | Beddow | A47G 21/06 | 30/147 |
| 2,470,492 | A * | 5/1949 | Jenkins | A47G 21/06 | D7/645 |
| 2,820,291 | A * | 1/1958 | Philippar | B26B 1/04 | 30/143 |
| 3,056,200 | A * | 10/1962 | Williams | A47G 21/06 | 30/148 |

(Continued)

FOREIGN PATENT DOCUMENTS

| | | |
|---|---|---|
| TW | M429428 U1 | 5/2012 |
| TW | M525135 U | 7/2016 |

(Continued)

*Primary Examiner* — Jason Daniel Prone

(74) *Attorney, Agent, or Firm* — Rosenberg, Klein & Lee

(57) ABSTRACT

A portable reusable utensil is provided that includes an upper casing, a lower casing, and a utensil body. The utensil body is mounted in a receiving space formed between the upper casing and the lower casing detachably connected to each other for storage and easy to carry. While in use, a service end of the utensil body is facing outwards while an assembly of the upper casing and the lower casing is used as a part held with user's hand to serve food. The design makes the portable reusable utensil more convenient to use.

4 Claims, 9 Drawing Sheets

(56) References Cited

U.S. PATENT DOCUMENTS 3,624,787 A * 11/1971 Newman ..... A47G 21/02 D7/392.1
4,377,035 A * 3/1983 Dalichow ..... A47G 21/06 30/147
4,539,749 A * 9/1985 Hyeong-Woon ..... A47G 21/06 30/147
5,261,560 A * 11/1993 Wang ..... A47G 21/06 30/326
D347,975 S * 6/1994 Zeller ..... D7/645
5,327,650 A * 7/1994 Rojas ..... A47G 21/06 30/147
5,669,143 A * 9/1997 Wu ..... A47G 21/02 30/322
6,055,733 A * 5/2000 Chen ..... A47G 21/10 30/143
6,237,226 B1 * 5/2001 Huang ..... A47G 21/02 30/322
7,093,363 B1 * 8/2006 Kuo ..... B26B 21/40 30/32
7,100,288 B2 * 9/2006 Kohler ..... A47G 21/06 30/147
D536,222 S * 2/2007 Heiberg ..... D7/645
7,805,843 B2 * 10/2010 Landsberger ..... B26B 5/00 30/142
D758,808 S * 6/2016 Gatewood ..... D7/645
9,434,590 B2 * 9/2016 Miksovsky ..... A47G 21/06
9,468,321 B2 * 10/2016 Miksovsky ..... A47G 21/023
9,560,925 B2 * 2/2017 Harris ..... G01C 17/02
D794,400 S * 8/2017 Young ..... D7/643
9,771,188 B2 * 9/2017 Glassman ..... A47G 21/02
10,857,661 B2 * 12/2020 Miksovsky ..... A47G 21/04
11,109,700 B2 * 9/2021 Henry ..... A47G 21/04
2002/0073553 A1 * 6/2002 Yang ..... A47G 21/06 30/322
2009/0144991 A1 * 6/2009 Synnestvedt ..... A47G 21/02 30/324
2009/0178284 A1 * 7/2009 Lane ..... A47G 21/02 30/340
2011/0219631 A1 * 9/2011 Hou ..... A47G 21/04 30/322
2015/0179086 A1 * 6/2015 Kim ..... A47G 21/04 434/260
2016/0039129 A1 * 2/2016 Hou ..... A47G 21/04 76/104.1
2017/0208976 A1 * 7/2017 Muise ..... A47G 21/02
2021/0022531 A1 * 1/2021 Forkan ..... A47G 21/06
2021/0345802 A1 * 11/2021 Elvin-Jensen ..... A47G 21/06
2021/0386228 A1 * 12/2021 Mertzel ..... A47G 21/02

FOREIGN PATENT DOCUMENTS

TW M547910 U 9/2017
TW M571159 U 12/2018

* cited by examiner

PORTABLE REUSABLE UTENSIL

BACKGROUND OF THE INVENTION

Field of the Invention

The present invention relates to a utensil, especially to a portable reusable utensil which not only can be taken apart and assembled for use but also can be assembled for storage. Thereby the portable reusable utensil has features of easy storage, convenient portability and environmental friendliness.

Description of Related Art

With the increasing awareness of environmental protection, more and more people carry their own eating utensils instead of the use of disposable tableware. Since the reusable utensil kits packed in a carry-on container has become a trend, people in the business have developed various kinds of eating utensil kits easy to carry out.

Refer to Taiwanese Pat. No. M571159U, eating utensils and a cutlery box are disclosed. The cutlery box includes a box, a mounting space with an opening facing upwards, a positioning piece having a plurality of slots and arranged in the mounting space, a plurality of eating utensils disposed and positioned in the slots of the positioning piece respectively, and a cover on top of the box for closing the mounting space.

Also refer to Taiwanese Pat. No. M547910U, an eating utensil case is revealed. The eating utensil consists of a base and a cover removably connected to the base. A receiving space is defined between the cover and the base and is communicating with a mounting inlet. At least one of the base and the cover is provided with a guide portion which is located adjacent to the mounting inlet and used for guiding one end of an eating utensil to be mounted into the receiving space.

Also refer to Taiwanese Pat. No. M525135U, a portable eating utensil set is disclosed. The portable eating utensil set is composed of a first chopstick body and a second chop stick body. A first chopstick portion is extending from one end of the first chopstick body and bent upward while the other end of the first chopstick portion is provided with a fork portion. The first chopstick portion and the fork portion are connected by a first connection portion. One end of the second chopstick body is provided with a second chopstick portion which is bent upward while a spoon portion is extending from the other end of the second chopstick portion. The second chopstick portion and the spoon portion are connected by a second connection portion.

Further refer to Taiwanese Pat. No. M429428U, a foldable cutlery set is revealed. The foldable cutlery set includes a handle and a main body for serving food. The handle is formed by a plurality of grip portions pivotally connected to one another and one end of the handle is pivotally connected to the main body. The respective grip portions can be rotated toward the main body so that the grip portions and the main body are stacked to be in a folded state. The respective grip portions can also be rotated in the direction away from the main body so that the respective grip portions and the main body are no more stacked and positioned at the central line of the main body to be in an extended state. The friction of the pivot part generated between the adjacent grip portions or the friction of the pivot part generated between the handle and the main body must be larger than the friction of the respective grip portions, the handle and the main body themselves generated while rotating freely.

There is room for improvement and there is a need to provide an improved portable eating utensil that is easy to carry and convenient to use for uses.

SUMMARY OF THE INVENTION

Therefore it is a primary object of the present invention to provide a portable reusable utensil which can be disassembled and assembled either for use or for storage. Thereby the portable reusable utensil is not only convenient to use but also easy to carry.

In order to achieve the above object, a portable reusable utensil according to the present invention includes an upper casing, a lower casing, and a utensil body.

The upper casing is composed of a first shell-like wall, two holding wings extending downward from two sides of the first shell-like wall respectively, and a locking protrusion arranged at and extending from the respective holding wings.

The lower casing consists of a second shell-like wall, an indent mounting slot formed on an inner surface of the second shell-like wall, two holding grooves arranged at two sides of the second shell-like wall respectively and corresponding to the two holding wings for holding and mounting each other, a lock indentation disposed on each of the holding grooves and corresponding to the locking protrusion for locking and positioning each other, a second tapered neck portion formed on one end thereof, a hole formed on the neck portion, and a fastening piece. A root portion formed on one end of the fastening piece is connected to the edge of the hole close to the end of the lower casing with the tapered neck while a free end is formed on the other end of the fastening piece opposite to the end thereof with the root portion and a locking point is formed on the free end.

The utensil body includes a service end, a positioning end opposite to the service end, and at least one positioning hole. The positioning hole is formed on the positioning end and corresponding to the locking point.

The upper casing and the lower casing are aligned and covered with each other. The upper casing and the lower casing are mounted and fixed by the holding wings being mounted into the holding grooves correspondingly and the locking protrusions being locked into the lock indentations. Thus a receiving space is formed between the upper casing and the lower casing. The utensil body is mounted therein and located between the upper and lower casings. The locking point of the fastening piece is also mounted and locked into one of the positioning hole on the positioning end of the utensil body. Thereby the utensil body can either be mounted into the receiving space with the service end thereof or be fixed under the condition that the service end thereof is pointing in the direction away from the receiving space.

Preferably, a distal part of the positioning end of the utensil body is provided with a mark portion which is exposed outside after the upper casing being mounted to the lower casing for storage of the utensil body.

Preferably, the service end of the utensil body can be a spoon, a fork, or a knife.

The portable reusable utensil according to the present invention has the following advantages:

1. A receiving space is formed between the upper casing and the lower casing combined with each other so that the utensil body can be mounted in the receiving space for easy storage and convenient portability. Or the service end of the utensil body is facing outwards while an assembly of the upper casing and the lower casing is used as a part that is held with user's hand for serving food. The portable reusable utensil is more convenient to use.

2. While the utensil body is mounted in the receiving space for storage, the mark portion is exposed outside the receiving space for allowing users to learn the type of the utensil body such as a fork, a spoon or a knife. Thereby users can select the type of the utensil body they need easily.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical features and functions of the present invention more clearly, please refer to the following embodiments with detailed descriptions, related figures and reference numbers.

Figure 1:
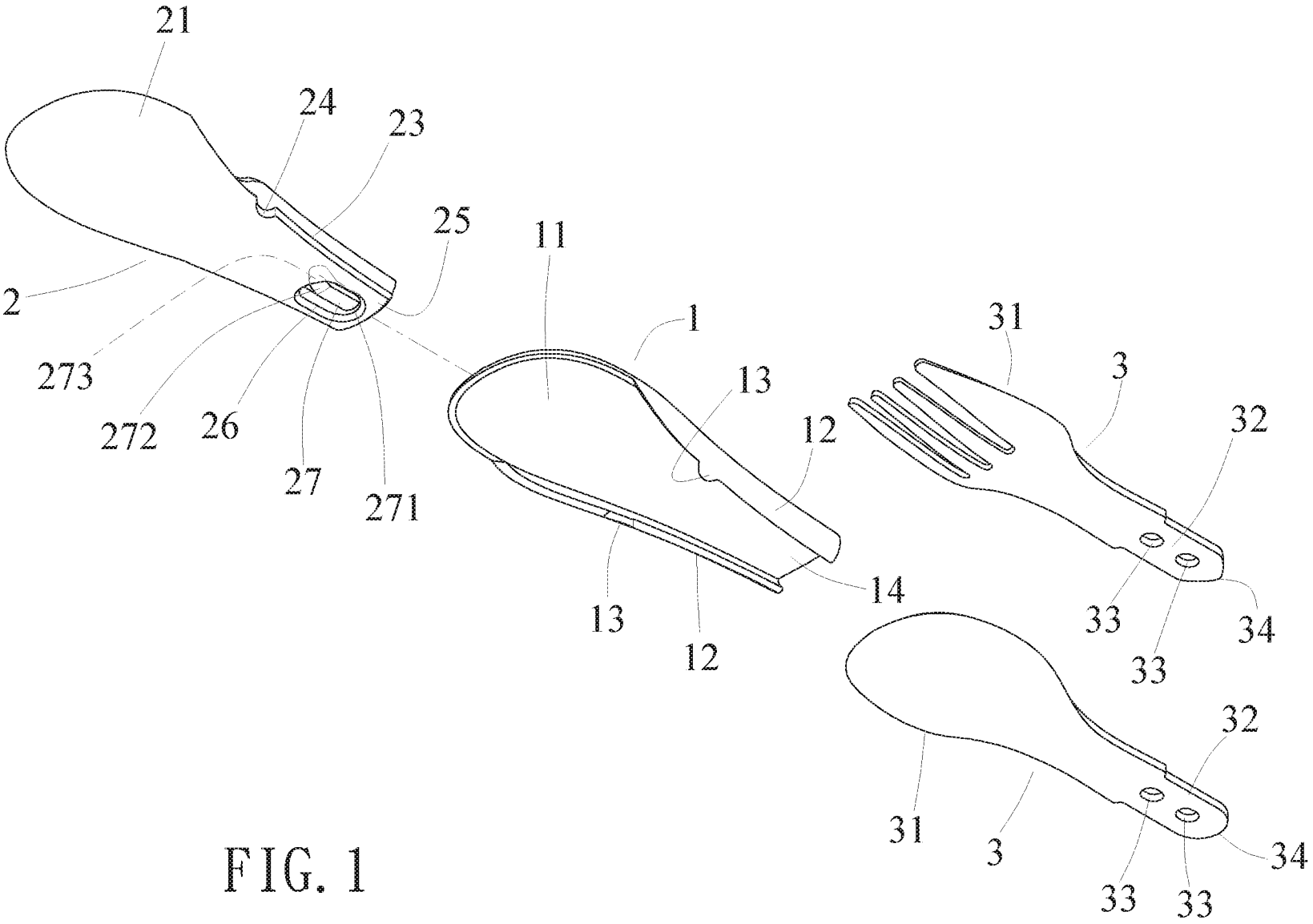
FIG. 1 is an explosive view of an embodiment according to the present invention.
Figure 2:
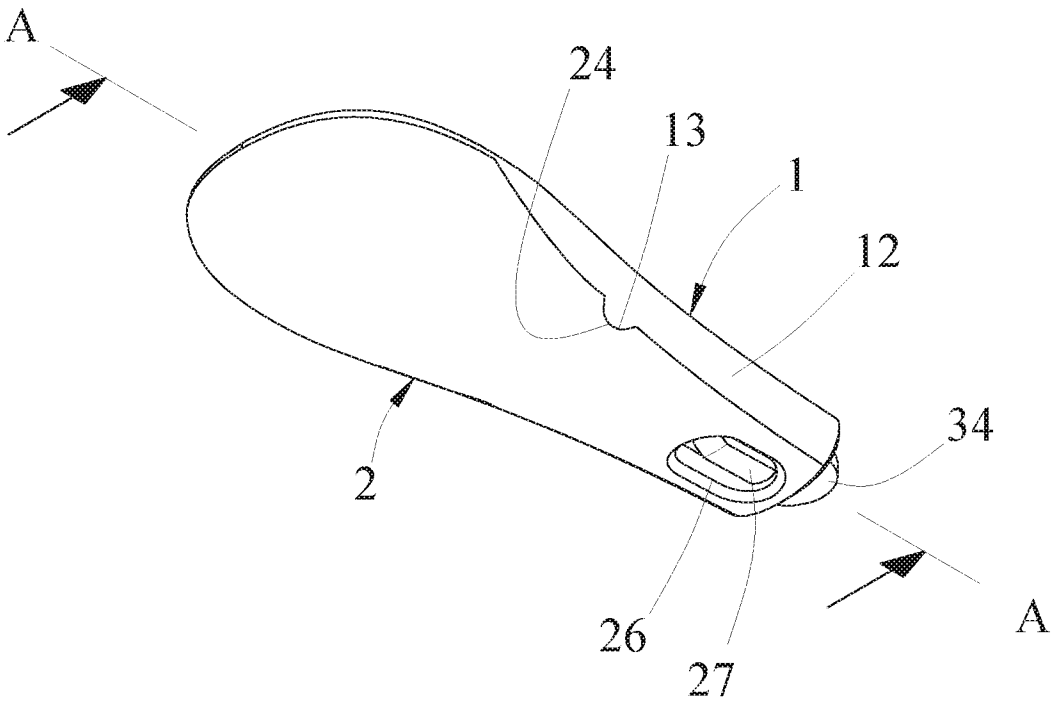
FIG. 2 is a perspective view of an embodiment in a folded status according to the present invention.

Refer to FIG. 1 and FIG. 2, a portable reusable utensil according to the present invention includes an upper casing 1, a lower casing 2 corresponding to and covered with the upper casing 1, and a utensil body 3 which is able to be mounted between the upper casing 1 and the lower casing 2 for storage or being connected to the upper casing 1 and the lower casing 2 in use.

The upper casing 1 consists of a first shell-like wall 11, two holding wings 12 extending downward from two sides of the first shell-like wall 11 respectively, and two locking protrusion 13 disposed on and extending from the holding wings 12 respectively. Preferably, on one end of the upper casing 1 is further provided with a first tapered neck portion 14.

The lower casing 2 is composed of a second shell-like wall 21, an indent mounting slot 22 formed on an inner surface of the second shell-like wall 21, two holding grooves 23 arranged at two sides of the second shell-like wall 21 respectively and corresponding to the two holding wings 12 for holding and mounting each other, a lock indentation 24 disposed on each of the holding grooves 23 and corresponding to the locking protrusion 13 for locking and positioning each other, a second tapered neck portion 25 formed on one end thereof and corresponding to one end of the upper casing 1, a hole 26 formed on the neck portion 25, and a fastening piece 27. A root portion 271 formed on one end of the fastening piece 27 is connected to the edge of the hole 26 close to the end of the lower casing 2 with the second tapered neck portion 25 while the other end of the fastening piece 27 opposite to the end thereof with the root portion 271 is provided with a free end 272 and a locking point 273 is formed on the free end 272.

The utensil body 3 includes a service end 31, a positioning end 32 opposite to the service end 31, and at least one positioning hole 33. The service end 31 can be a spoon, a fork, or a knife. The positioning hole 33 is disposed on the positioning end 32 and corresponding to the locking point 273. In this embodiment, the positioning end 32 of the utensil body 3 is provided with two positioning holes 33. The locking point 273 is mounted and locked into one of the positioning holes 33 according to the position or direction of the utensil body 3 being connected to the upper and lower casings 1, 2. There could be only one positioning hole 33 as long as the locking point 273 is able to be mounted and locked into the positioning holes 33 while the position the utensil body 3 being connected to the upper and lower casings 1, 2.

Refer to FIGS. 2-5, while not in use, the service end 31 of the utensil body 3 is aligned with the mounting slot 22 of the lower casing 2. Then the service end 31 of the utensil body 3 is mounted into the mounting slot 22 of the lower casing 2 and the locking point 273 of the lower casing 2 is also locked into one of the positioning holes 33 correspondingly for fixing the utensil body 3 in the lower casing 2. Then the upper casing 1 is moved over the lower casing 2 through the second tapered neck portion 25 of the lower casing 2. By the holding wings 12 being mounted into the holding grooves 23 correspondingly, the upper casing 1 is guided to slide smoothly on the lower casing 2 until the locking protrusions 13 being mounted and locked in the lock indentations 24. Thereby the upper casing 1 and the lower casing 2 are connected and fixed. Thus the utensil body 3 can be mounted into a receiving space formed between the upper casing 1 and the lower casing 2 for storage.

Figure 3:
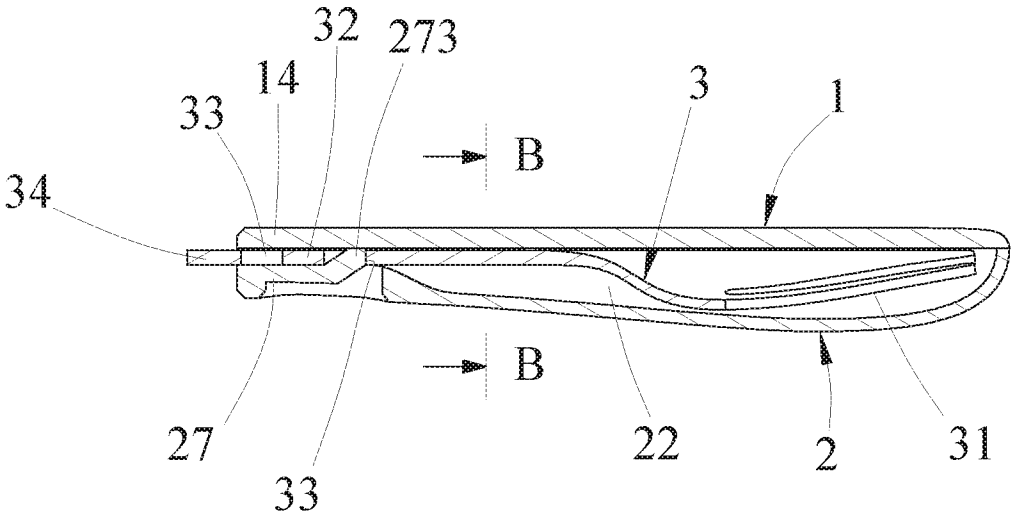
FIG. 3 is a sectional view along the line A-A of the embodiment in FIG. 2.
Figure 4:
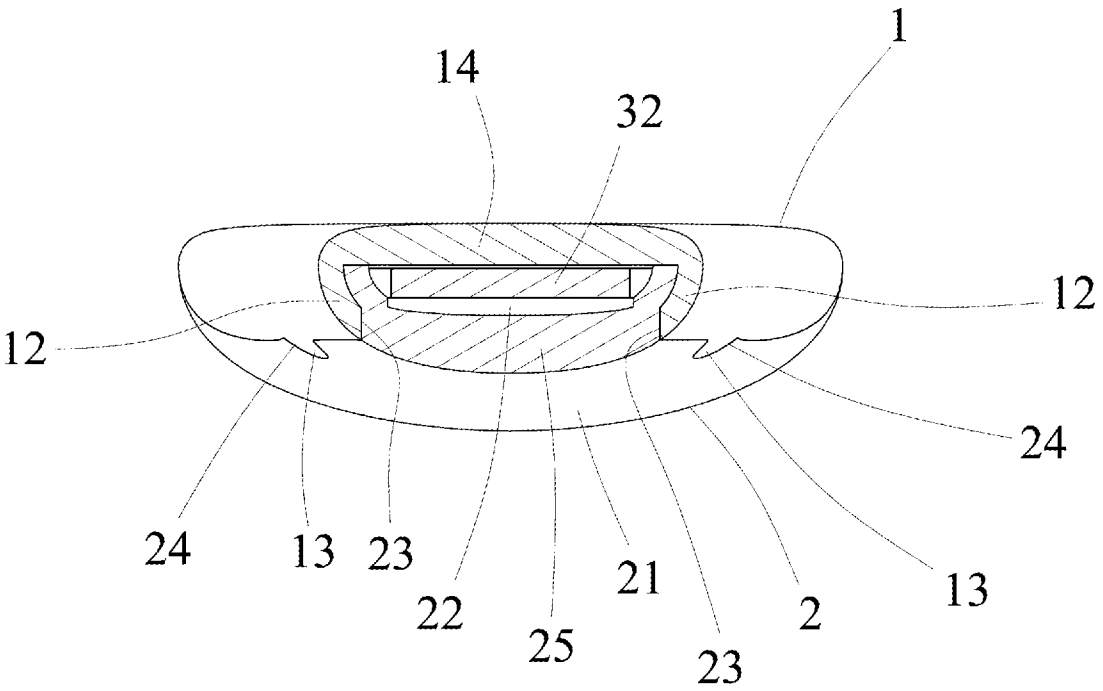
FIG. 4 is a sectional view along the line B-B of the embodiment in FIG. 3.

In a preferred embodiment, the utensil body 3 further includes a mark portion 34 disposed on a distal part of the positioning end 32 thereof, as shown in FIG. 2 and FIG. 3. After the upper casing 1 and the lower casing 2 already being connected for storage of the utensil body 3, the mark portion 34 is exposed (located outside the assembly of the upper and the lower casings 1, 2) so that users can learn the type of the utensil such as spoon, fork or knife arranged at the service end 31 of the utensil body 3 and mounted in the upper casing 1 and the lower casing 2 for storage.

Figure 5:
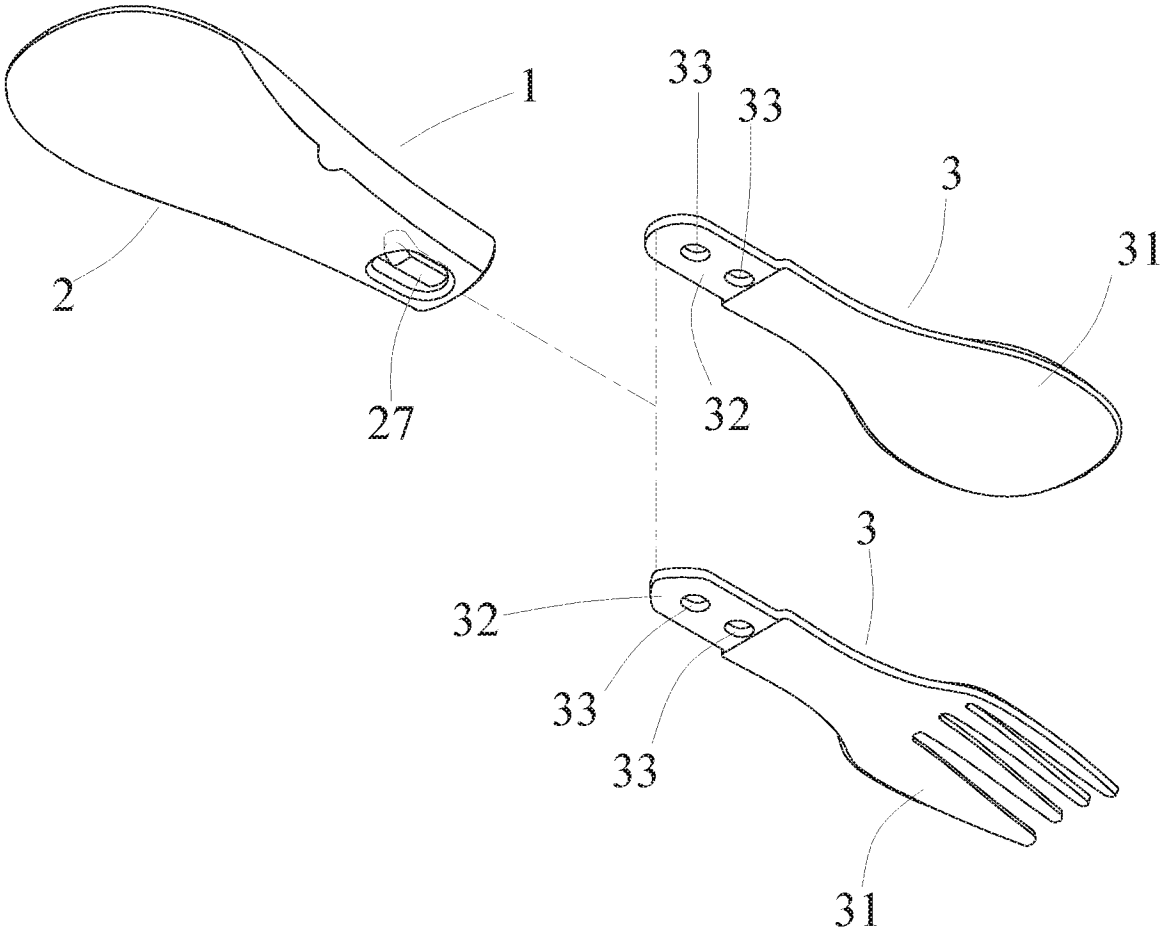
FIG. 5 is an explosive view showing an upper casing, a lower casing, and a utensil body of an embodiment before being assembled to be used according to the present invention.

Refer to FIG. 5, while in use, open the upper casing 1 and the lower casing 2 and take out the utensil body 3. Then after the upper casing 1 and the lower casing 2 being connected and fixed, the service end 31 of the utensil body 3 is arranged at the position opposite to the receiving space between the upper casing 1 and the lower casing 2 and pointing in the direction away from the receiving space. The positioning end 32 of the utensil body 3 is inserted into the receiving space between the neck portion 14 of the upper casing 1 and the neck portion 25 of the lower casing 2, as show in FIGS. 6-8. And the locking point 273 on the fastening piece 27 of the lower casing 2 is mounted and locked into the positioning hole 33 of the utensil body 3 so that the utensil body 3 is further fixed. By the upper casing 1 and the lower casing 2 combined with each other to form a part which is held with users' hand, users can use the service end 31 of the utensil body 3 to scoop up food.

Figure 6:
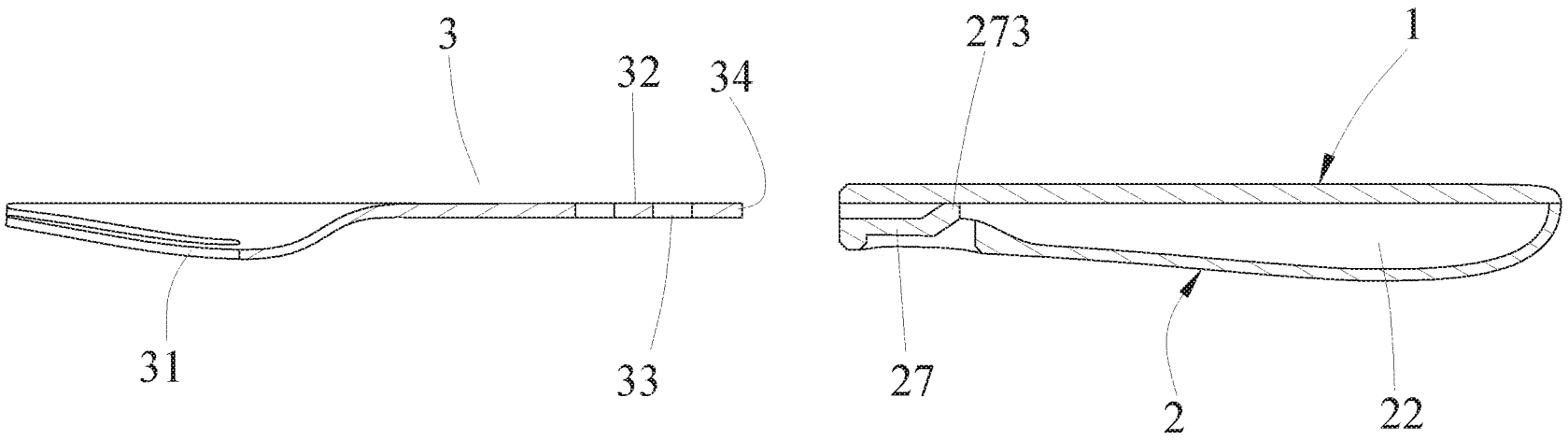
FIG. 6 is a side view of an upper casing, a lower casing, and a utensil body (fork) of an embodiment during assembly according to the present invention.
Figure 7:
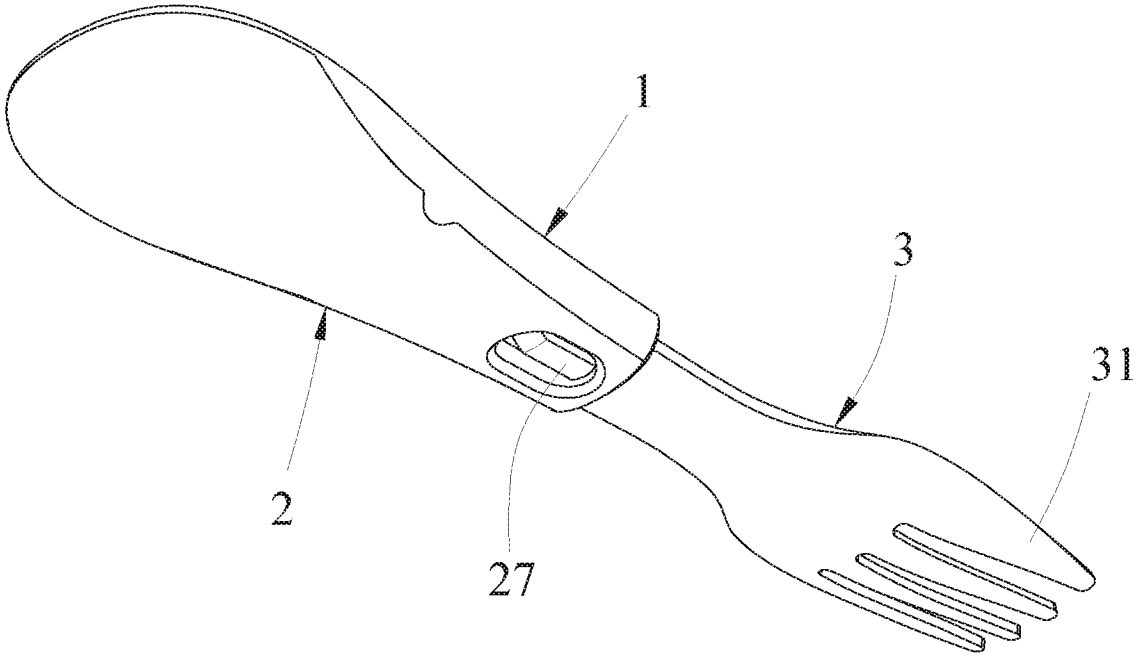
FIG. 7 is a perspective view of an upper casing, a lower casing, and a utensil body (fork) of an embodiment being assembled and ready for use according to the present invention.
Figure 8:
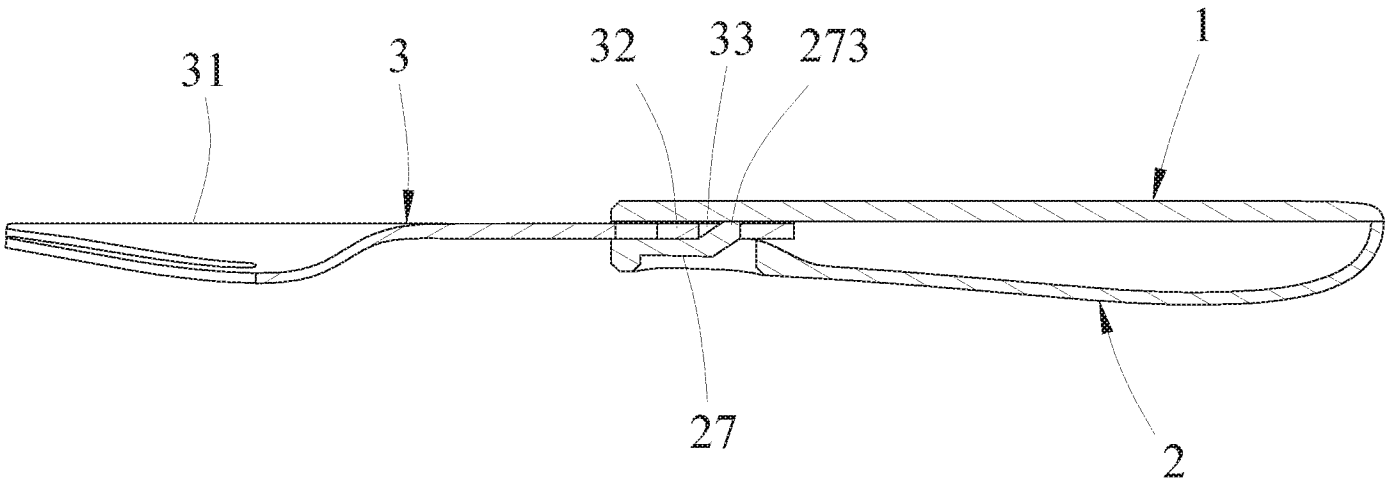
FIG. 8 is a side view of an upper casing, a lower casing, and a utensil body (fork) of an embodiment being assembled and ready for use according to the present invention.
Figure 9:
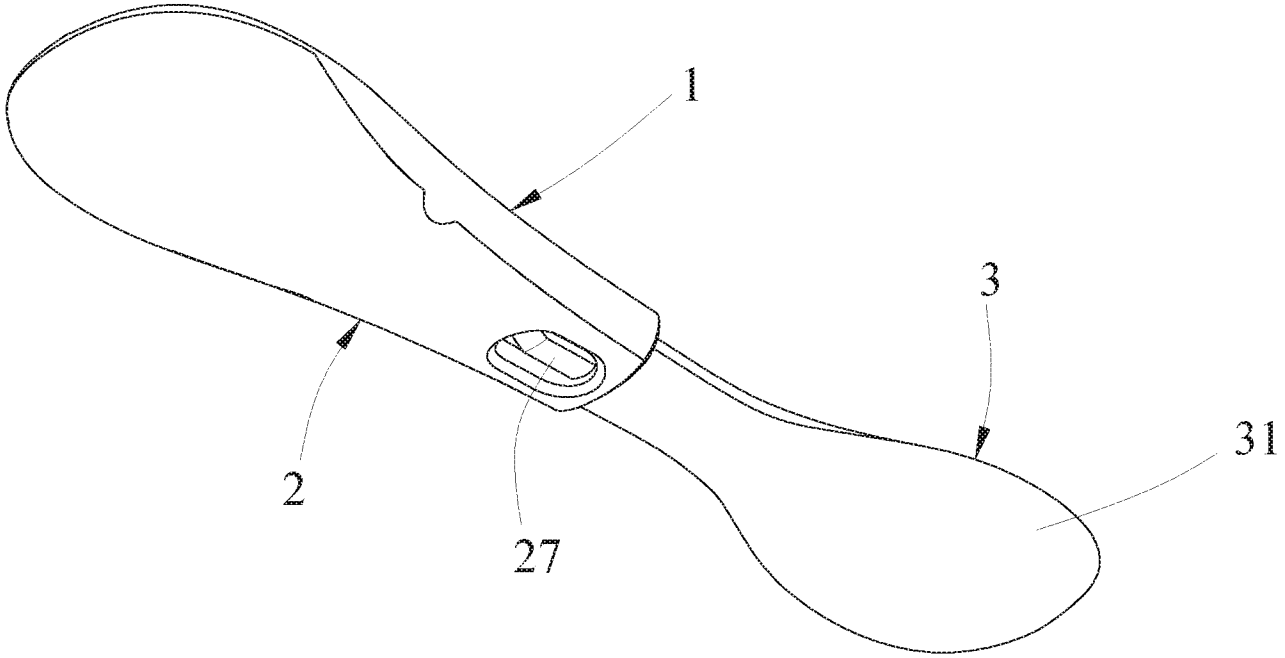
FIG. 9 is a perspective view of an upper casing, a lower casing, and a utensil body (spoon) of an embodiment being assembled and ready for use according to the present invention.

Refer to FIGS. 6-8, the service end 31 of the utensil body 3 in use is a fork. As to the embodiment shown in FIG. 9, the service end 31 of the utensil body 3 in use is a spoon. The service end 31 of the utensil body 3, shown in the figure, can also be a knife of a known shape.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A portable reusable utensil comprising an first casing, a second casing opposite the first casing, and a utensil body;

wherein the first casing includes a first wall, two holding wings extending inward from two sides of the first wall respectively, and a locking protrusion arranged on and extending from a respective one of the holding wings; wherein the second casing includes a second wall, an indent mounting slot formed on an inner surface of the second wall, two holding grooves arranged at two sides of the second wall respectively and corresponding to the two holding wings for holding and mounting each other, a lock indentation disposed on each of the holding grooves and corresponding to the locking protrusion for locking and positioning each other, a tapered neck portion formed on one end thereof, a hole formed on the neck portion, and a fastening piece; a root portion formed on one end of the fastening piece is connected to an edge of the neck portion defining the hole close to the end of the second casing with the tapered neck portion while a free end is formed on another end of the fastening piece opposite to the end of the fastening piece with the root portion and a locking point is defined by the free end;

wherein the utensil body includes a service end, a positioning end opposite to the service end, and at least one positioning hole which is formed on the positioning end and corresponding to the locking point;

wherein the first casing and the second casing are aligned with and mounted to each other; the first casing and the second casing are detachably connected and fixed by the holding wings being mounted into the holding grooves correspondingly and the locking protrusions being locked into the lock indentations while a receiving space is defined between the first wall and the wings of the first casing and the indent mounting slot of the second casing; the utensil body is able to be mounted between the first casing and the second casing; the locking point of the fastening piece is mounted and locked into the at least one positioning hole on the positioning end of the utensil body; thereby the utensil body is able to be mounted in a first orientation where the service end is received in the receiving space for storage and in an opposite second orientation where the service end is exposed outside of the casings and points in a direction away from the receiving space for use.

2. The device as claimed in claim 1, wherein the service end of the utensil body is selected from the group consisting of a spoon, a fork, and a knife.

3. The device as claimed in claim 1, wherein a distal part of the positioning end of the utensil body is provided with a mark portion which is exposed outside of the casings when the utensil body is mounted in the first orientation.

4. The device as claimed in claim 3, wherein the service end of the utensil body is selected from the group consisting of a spoon, a fork, and a knife.

* * * * *